US007591544B2

(12) United States Patent
Shimada

(10) Patent No.: US 7,591,544 B2
(45) Date of Patent: Sep. 22, 2009

(54) LIQUID EJECTING HEAD, METHOD OF PRODUCING THE SAME, AND LIQUID EJECTING APPARATUS

(75) Inventor: Masato Shimada, Chino (JP)

(73) Assignee: Seiko Epson Corporation, Tokyo (JP)

( * ) Notice: Subject to any disclaimer, the term of this patent is extended or adjusted under 35 U.S.C. 154(b) by 297 days.

(21) Appl. No.: 11/758,560

(22) Filed: Jun. 5, 2007

(65) Prior Publication Data

US 2007/0279456 A1 Dec. 6, 2007

(30) Foreign Application Priority Data

Jun. 5, 2006 (JP) ..... 2006-156566

(51) Int. Cl.
*B41J 2/045* (2006.01)

(52) U.S. Cl. ..... 347/68

(58) Field of Classification Search ..... 347/68, 347/69–72; 400/124.16
See application file for complete search history.

(56) References Cited

U.S. PATENT DOCUMENTS

| | | | | |
|---|---|---|---|---|
| 7,101,026 | B2 * | 9/2006 | Shimada et al. | 347/68 |
| 7,350,904 | B2 * | 4/2008 | Noguchi et al. | 347/72 |

FOREIGN PATENT DOCUMENTS

| | | |
|---|---|---|
| JP | 10-286960 | 10/1998 |
| JP | 11-129473 | 5/1999 |
| JP | 11-227190 | 8/1999 |
| JP | 2003-118126 | 4/2003 |
| JP | 2004-082722 | 3/2004 |
| JP | 2004-090279 | 3/2004 |
| JP | 2004-209874 | 7/2004 |
| JP | 2004-262225 | 9/2004 |
| JP | 2002-370368 | 12/2004 |

* cited by examiner

*Primary Examiner*—K. Feggins
(74) *Attorney, Agent, or Firm*—Workman Nydegger

(57) ABSTRACT

A liquid ejecting head includes a channel-forming substrate that communicates with nozzle orifices for ejecting a liquid and that includes a plurality of pressure-generating chambers separated by a plurality of partition walls and arranged in parallel in a direction in which a short side thereof extends; and pressure-generating elements that are provided on a surface of the channel-forming substrate, with a diaphragm therebetween, and that provide the pressure-generating chambers with a pressure change. In the liquid ejecting head, recesses that open to the side of the pressure-generating chambers are provided on areas of the diaphragm, the areas facing the pressure-generating chambers; opening edges of each of the recesses are disposed at the same positions as corners each defined by an inner surface of the corresponding partition wall, the inner surface defining a side surface of the pressure-generating chamber, and a surface of the partition wall that is joined to the diaphragm; and side surfaces of each of the recesses form inclined surfaces that are inclined so that the width of the recess at the bottom surface of the recess is smaller than the width of the recess at the opening edges of the recess.

7 Claims, 10 Drawing Sheets

LIQUID EJECTING HEAD, METHOD OF PRODUCING THE SAME, AND LIQUID EJECTING APPARATUS

The entire disclosure of Japanese Patent Application No. 2006-156566, filed Jun. 5, 2006 is expressly incorporated by reference herein.

BACKGROUND

1. Technical Field

The present invention relates to a liquid ejecting head that ejects a liquid from nozzle orifices, a method of producing the liquid ejecting head, and a liquid ejecting apparatus, and in particular, to an ink jet recording head that discharges ink as a liquid, a method of producing the ink jet recording head, and an ink jet recording apparatus.

2. Related Art

Various types of ink jet recording heads, which are liquid ejecting heads used for printers, facsimile machines, copy machines, or the like utilizing a mechanism for discharging ink droplets are known. In an example of such an ink jet recording head, a part of each of pressure-generating chambers communicating with nozzle orifices is composed of a diaphragm, and the shape of this diaphragm is changed by a displacement of piezoelectric elements, thereby expanding or contracting the volume of the pressure-generating chambers. Thus, droplets are discharged from the nozzle orifices. In another example of such an ink jet recording head, the shape of a diaphragm is changed by utilizing an electrostatic force, thereby changing the volume of pressure-generating chambers. Thus, droplets are discharged from the nozzle orifices.

In a known method of producing such an ink jet recording head, for example, pressure-generating elements such as piezoelectric elements are formed on a surface of a channel-forming substrate composed of a single-crystal silicon substrate, with a diaphragm therebetween. Anisotropic etching is then performed from the side of another surface of the channel-forming substrate to the diaphragm, thereby forming pressure-generating chambers and the like.

Examples of such an ink jet recording head and a production method thereof include a structure in which a recess having a width larger than the width of a pressure-generating chamber is formed on an area of a diaphragm, the area facing the pressure-generating chamber, by anisotropic etching (for example, see JP-A-11-227190, p. 5 and FIG. 5), a structure in which a recess that has a width larger than or smaller than the width of a pressure-generating chamber and that has round-shaped corners is formed on a diaphragm (for example, see JP-A-2004-209874, pp. 5 to 7 and FIGS. 2 to 5), and a structure in which a recess or a protrusion is provided at the side of a diaphragm of partition walls constituting a pressure-generating chamber (for example, Japanese Patent No. 3713921, pp. 7 to 10 and FIGS. 1 and 3).

However, in the structure in which a recess having a width larger than the width of a pressure-generating chamber is formed on a diaphragm, the area where partition walls are in contact with the diaphragm is decreased, thereby decreasing the adhesion area. This structure causes a problem of decreasing the adhesive force between the partition walls and the diaphragm which counters the reactive force of ink during discharge of the ink. This structure is also disadvantageous in that the diaphragm may be separated from the partition walls when the driving of piezoelectric elements is repeatedly performed, and breakages, such as cracks, may be generated in the diaphragm in the boundary portions between the partition walls and the pressure-generating chamber.

When a recess having a width smaller than that of a pressure-generating chamber is formed on a diaphragm, displacement characteristics cannot be improved by controlling the thickness of the diaphragm, and displacement characteristics of the diaphragm cannot be uniform because of variations in the width of the recess.

These problems similarly occur not only in ink jet recording heads that discharge ink but also in liquid ejecting heads that eject a liquid other than ink.

SUMMARY

An advantage of some aspects of the invention is that it provides a liquid ejecting head in which the adhesive force between a diaphragm and partition walls is ensured to improve the driving durability, and thus the reliability is improved, a method of producing the liquid ejecting head, and a liquid ejecting apparatus.

According to a first aspect of the invention, a liquid ejecting head includes a channel-forming substrate that communicates with nozzle orifices for ejecting a liquid and that includes a plurality of pressure-generating chambers separated by a plurality of partition walls and arranged in parallel in a direction in which a short side thereof extends; and pressure-generating elements that are provided on a surface of the channel-forming substrate, with a diaphragm therebetween, and that provide the pressure-generating chambers with a pressure change. In the liquid ejecting head according to the first aspect of the invention, recesses that open to the side of the pressure-generating chambers are provided on areas of the diaphragm, the areas facing the pressure-generating chambers; opening edges of each of the recesses are disposed at the same positions as corners each defined by an inner surface of the corresponding partition wall, the inner surface defining a side surface of the pressure-generating chamber, and a surface of the partition wall that is joined to the diaphragm; and side surfaces of each of the recesses form inclined surfaces that are inclined so that the width of the recess at the bottom surface of the recess is smaller than the width of the recess at the opening edges of the recess.

According to the first aspect of the invention, the thickness of the diaphragm is decreased by forming the recesses. Consequently, displacement characteristics of the diaphragm can be improved to improve liquid-ejecting characteristics. Furthermore, the area where the partition walls are in contact with the diaphragm is not decreased, thus preventing the separation of the diaphragm from the partition walls. Furthermore, the rigidity of a boundary portion of the diaphragm, the boundary portion between each partition wall and each pressure-generating chamber, is improved, thus preventing the generation of cracks and the like in the boundary portion. Accordingly, the driving durability can be improved, and the reliability can be improved.

Each of the inclined surfaces of the recess is preferably composed of a plurality of tapered portions having different angles of inclination.

In this case, when each of the inclined surfaces is composed of a plurality of tapered portions, liquid-ejecting characteristics can be improved, and the separation between the diaphragm and the partition walls can be reliably prevented. Furthermore, the rigidity of a boundary portion of the diaphragm, the boundary portion between each partition wall and each pressure-generating chamber, is improved, thus reliably preventing the generation of cracks and the like in the boundary portion.

Among the tapered portions, a tapered portion closer to the pressure-generating element preferably has a smaller angle of inclination with respect to the thickness direction of the diaphragm.

In this case, the rigidity of a boundary portion of the diaphragm, the boundary portion between each partition wall and each pressure-generating chamber, can be further improved, thus reliably preventing the generation of cracks and the like in the boundary portion.

A protective film having a liquid resistance is preferably provided on the inner surfaces of the pressure-generating chambers.

In this case, when the opening edges of the recess are disposed at the same positions as corners of the corresponding partition walls and the side surfaces of the recesses are the inclined surfaces, the uniformity of the protective film can be improved, thus reliably preventing breakages of the channel-forming substrate, the diaphragm, and the like due to infiltration of a liquid.

The channel-forming substrate is preferably composed of a single-crystal silicon substrate. In addition, the bottom layer of the diaphragm, the bottom layer being adjacent to the channel-forming substrate, is preferably composed of an elastic film made of silicon dioxide, and the recesses are preferably provided on the elastic film.

In this case, the recesses can be easily formed with high accuracy.

According to a second aspect of the invention, a liquid ejecting apparatus includes the liquid ejecting head according to the first aspect of the invention.

According to the second aspect of the invention, a liquid ejecting apparatus having improved reliability can be realized.

A third aspect of the invention provides a method of producing a liquid ejecting head including a channel-forming substrate that communicates with nozzle orifices for ejecting a liquid and that includes a plurality of pressure-generating chambers separated by a plurality of partition walls and arranged in parallel in a direction in which a short side thereof extends; and pressure-generating elements that are provided on a surface of the channel-forming substrate, with a diaphragm therebetween, and that provide the pressure-generating chambers with a pressure change, wherein recesses that open to the side of the pressure-generating chambers are provided on areas of the diaphragm, the areas facing the pressure-generating chambers; opening edges of each of the recesses are disposed at the same positions as corners each defined by an inner surface of the corresponding partition wall, the inner surface defining a side surface of the pressure-generating chamber, and a surface of the partition wall that is joined to the diaphragm; and side surfaces of each of the recesses form inclined surfaces that are inclined so that the width of the recess at the bottom surface of the recess is smaller than the width of the recess at the opening edges of the recess. The method according to the third aspect of the invention includes forming the diaphragm and the pressure-generating elements on a surface of the channel-forming substrate; and anisotropically etching the channel-forming substrate from the side of another surface thereof, thereby forming the pressure-generating chambers in which the direction in which the short side thereof extends is defined by the partition walls, and in addition, thereby etching the partition walls in the direction in which the short side thereof extends, and etching areas of the diaphragm, the areas facing the pressure-generating chambers to form the recesses each having the inclined surfaces utilizing a difference between the etching rate of the partition walls and the etching rate of the diaphragm.

According to the third aspect of the invention, recesses having a desired shape can be easily formed with high accuracy by anisotropic etching, and the recesses and the pressure-generating chambers can be formed at the same time. Consequently, the production process can be simplified and the production cost can be reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

The invention will now be described using embodiments.

First Embodiment

Figure 1:
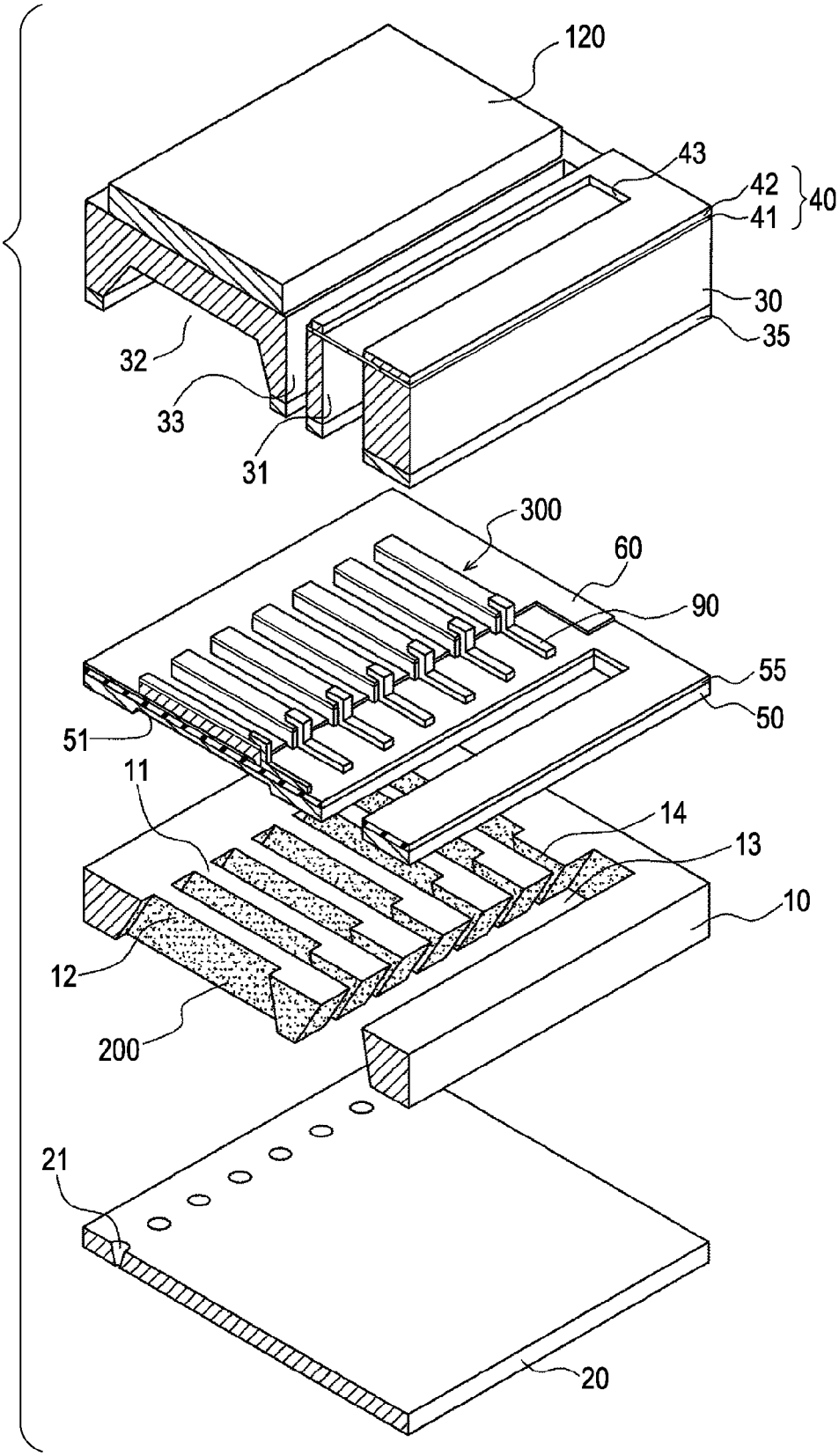
FIG. 1 is an exploded perspective view of a recording head according to a first embodiment.
Figure 2A:
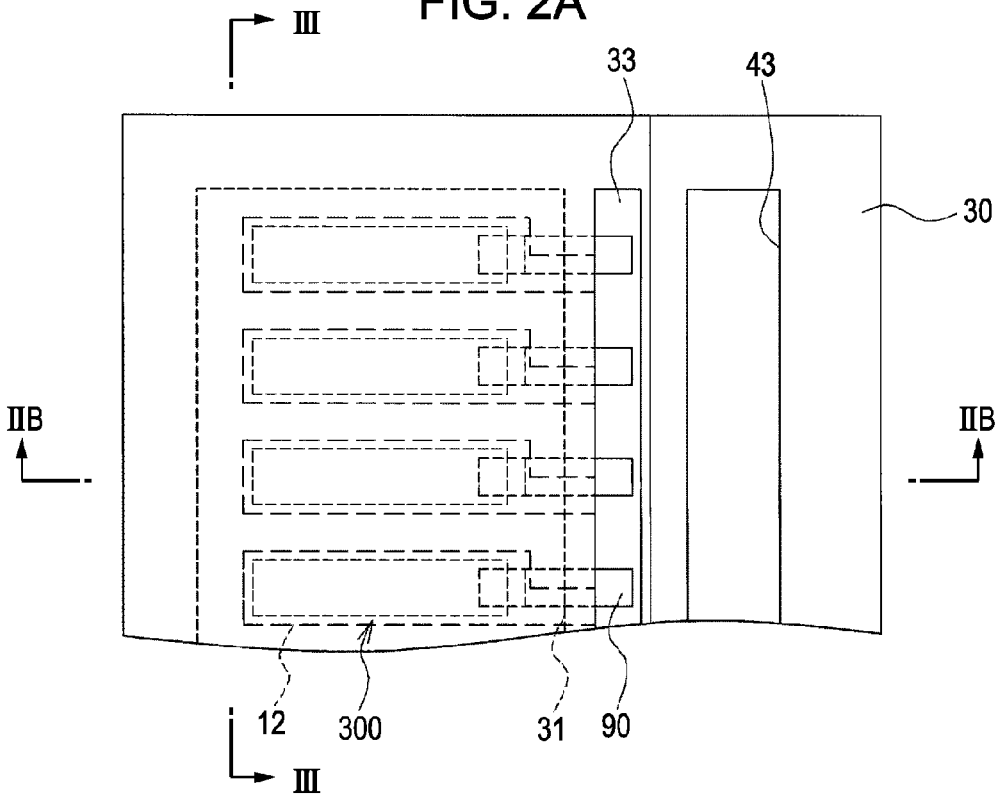
FIG. 2A is a plan view of the recording head according to the first embodiment.
Figure 2B:
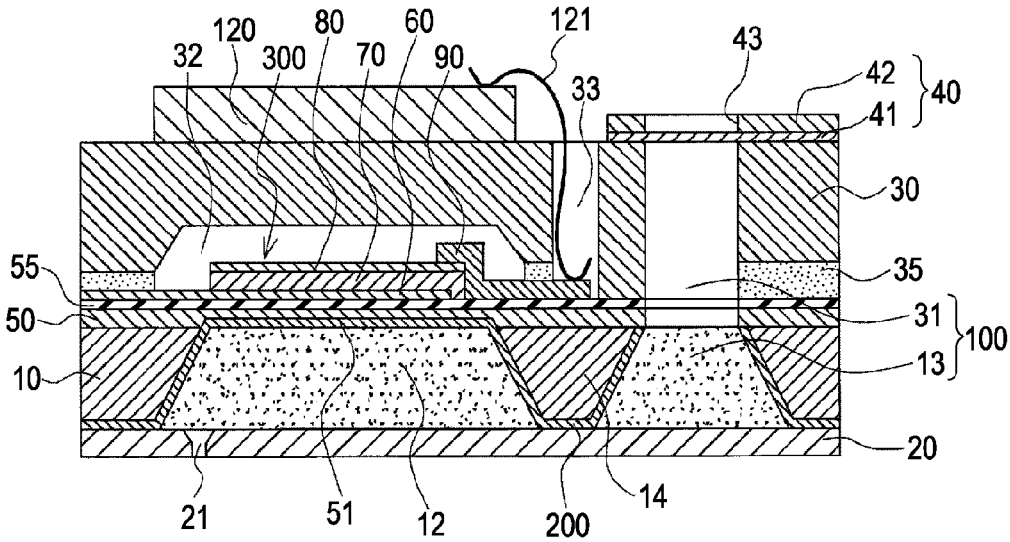
FIG. 2B is a cross-sectional view of the recording head according to the first embodiment.
Figure 3A:
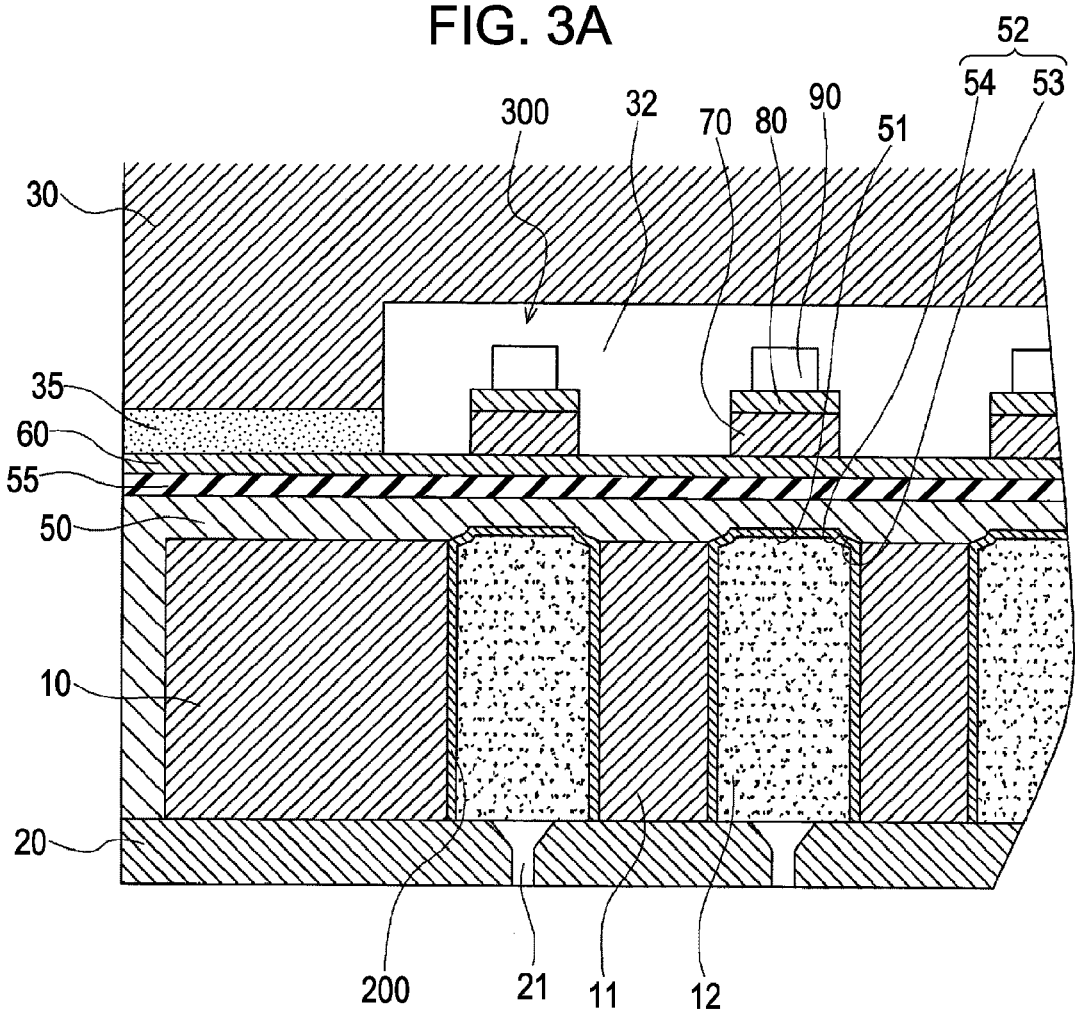
FIG. 3A is a cross-sectional view of the recording head according to the first embodiment.
Figure 3B:
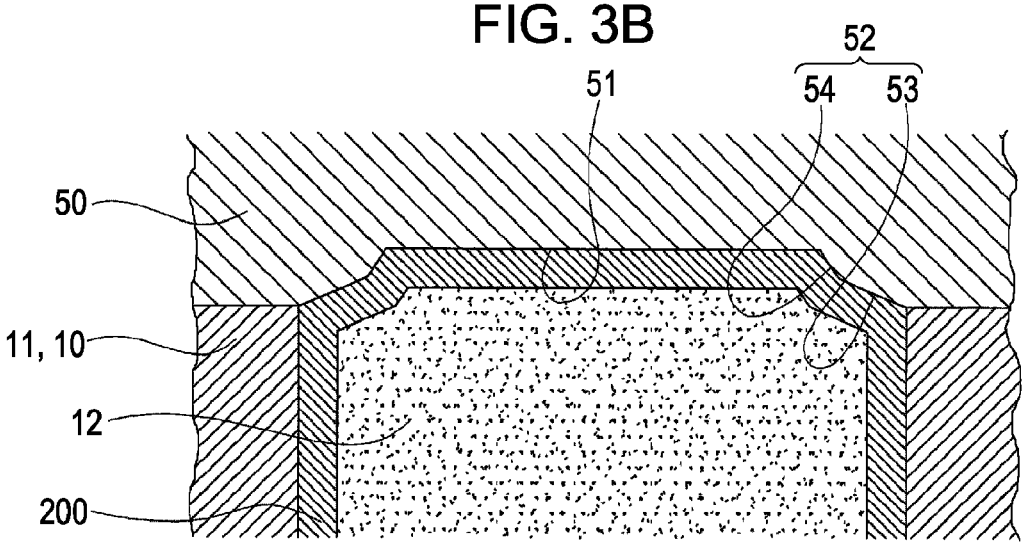
FIG. 3B is an enlarged cross-sectional view of the relevant part of the recording head according to the first embodiment.

FIG. 1 is an exploded perspective view of an ink jet recording head, which is an example of a liquid ejecting head, according to a first embodiment of the invention. FIG. 2A is a plan view of the ink jet recording head shown in FIG. 1, and FIG. 2B is a cross-sectional view taken along line IIB-IIB in FIG. 2A. FIG. 3A is a cross-sectional view taken along line III-III in FIG. 2A, and FIG. 3B is a cross-sectional view of the relevant part of FIG. 3A. As shown in the figures, in this embodiment, a channel-forming substrate 10 is composed of a single-crystal silicon substrate having a crystal plane direction of (110). A silicon dioxide elastic film 50 having a thickness in the range of 0.5 to 2 μm is formed in advance on one surface of the channel-forming substrate 10 by thermal oxidation.

A plurality of pressure-generating chambers 12 separated by a plurality of partition walls 11 are arranged on the channel-forming substrate 10 in the width direction (the short-side direction) of the pressure-generating chambers 12. The pressure-generating chambers 12 are formed by anisotropically etching the channel-forming substrate 10 from the other surface side of the channel-forming substrate 10. A communication section 13 is provided in an area disposed to one side of the pressure-generating chambers 12 in the longitudinal direction of the pressure-generating chambers 12 of the channel-forming substrate 10. The communication section 13 communicates with each of the pressure-generating chambers 12 via an ink supply channel 14 provided for each pressure-generating chamber 12. The communication section 13 communicates with a reservoir section 31 of a protective substrate 30 described below to constitute a part of a reservoir 100 serving as a common liquid chamber of the pressure-generating chambers 12. The ink supply channel 14 is formed so as to have a width smaller than the width of each pressure-generating chamber 12 and maintains the channel resistance of ink supplied from the communication section 13 to the pressure-generating chamber 12 to be constant. In this embodiment, the ink supply channel 14 is formed by reducing the width of the channel at one side. Alternatively, the ink supply channel 14 may be formed by reducing the width of the channel at both sides. Alternatively, the ink supply channel 14 may be formed by reducing the thickness of the channel, instead of reducing the width of the channel.

The pressure-generating chambers 12, the ink supply channels 14, and the communication section 13 are formed by anisotropically etching the channel-forming substrate 10 from the surface opposite the elastic film 50. The anisotropic etching is performed by utilizing differences in the etching rate of the single-crystal silicon substrate for different planes. In this embodiment, a single-crystal silicon substrate having a plane of (110) is used as the channel-forming substrate 10. Accordingly, the anisotropic etching is performed by utilizing a property that the etching rate of (111) planes is about 1/180 of the etching rate of the (110) plane of a single-crystal silicon substrate. More specifically, when the single-crystal silicon substrate is immersed in an alkaline solution such as an aqueous KOH solution, the substrate is gradually corroded and a first (111) plane perpendicular to the (110) plane and a second (111) plane that forms an angle of about 70 degrees with this first (111) plane and that forms an angle of about 35 degrees with the (110) plane appear. By use of this anisotropic etching, high-precision processing can be performed on the basis of depth processing to produce a parallelogram shape, which is formed by two of the first (111) planes and two of the oblique second (111) planes. Thus, the pressure-generating chambers 12 can be arranged with high density.

In each of the partition walls 11 of this embodiment formed by anisotropically etching the channel-forming substrate 10, the inner surfaces defining the side surfaces of the pressure-generating chamber 12 arranged in a direction in which a short side of one pressure-generating chamber 12 extends are composed of the first (111) planes perpendicular to the (110) plane of the surface of the channel-forming substrate 10. That is, the width of each partition wall 11 in a direction in which the short side of the pressure-generating chamber 12 extends is uniform in the thickness direction of the channel-forming substrate 10.

As shown in FIGS. 3A and 3B, which will be described in detail below, recesses 51 each opening to the side of the pressure-generating chamber 12 are provided in an area of the elastic film 50 constituting a diaphragm of this embodiment, the area facing the pressure-generating chamber 12. These recesses 51 can be simultaneously formed by anisotropically etching the elastic film 50 used as the diaphragm when the partition walls 11 and the pressure-generating chambers 12 are formed by anisotropically etching the channel-forming substrate 10.

A protective film 200 made of a material having a liquid resistance (ink resistance) is provided on the inner surfaces of the pressure-generating chambers 12, the recesses 51, the ink supply channels 14, and the communication section 13 in the channel-forming substrate 10. In this embodiment, a tantalum oxide film, for example, a tantalum pentoxide ($Ta_2O_5$) film having a thickness of about 50 nm is provided as the protective film 200. The term "ink resistance" used herein means the etching resistance against alkaline ink. In this embodiment, the protective film 200 is not provided on a surface of the channel-forming substrate 10 to which the pressure-generating chambers 12 and the like are opened, that is, on a joint surface to which a nozzle plate 20 is joined. Alternatively, the protective film 200 may also be provided on this area.

The material of the protective film 200 is not limited to tantalum oxides. For example, zirconium oxide ($ZrO_2$), nickel (Ni), or chromium (Cr) may also be used in accordance with the pH of ink used.

The nozzle plate 20 having nozzle orifices 21 drilled therein is fixed to the channel-forming substrate 10 at an open surface side thereof with an adhesive, a thermowelding film, or the like. The nozzle orifices 21 communicate with the pressure-generating chambers 12 at sides opposite the ink supply channel 14. The nozzle plate 20 is made of a glass-ceramic, a single-crystal silicon substrate, a stainless steel, or the like.

As described above, the elastic film 50 having a thickness of, for example, about 1.0 μm is provided on the other surface of the channel-forming substrate 10, the surface opposite the nozzle plate 20. An insulating film 55 having a thickness of, for example, about 0.4 μm is provided on this elastic film 50. Furthermore, on the insulating film 55, a lower electrode film 60 having a thickness of, for example, about 0.2 μm, a piezoelectric layer 70 having a thickness of, for example, about 1.0 μm, and an upper electrode film 80 having a thickness of, for example, about 0.05 μm are stacked by a process described below to form piezoelectric elements 300. Herein, the piezoelectric element 300 indicates a portion including the lower electrode film 60, the piezoelectric layer 70, and the upper electrode film 80. In general, either one of the electrodes of each of the piezoelectric elements 300 is used as a common electrode, and the other electrode and the piezoelectric layer 70 are patterned on each pressure-generating chamber 12, thus forming the piezoelectric elements 300. Herein, a portion which is composed of the patterned electrode and the piezoelectric layer 70 and in which a piezoelectric strain is generated by applying a voltage to both electrodes is referred to as "piezoelectric active portion". In this embodiment, the lower electrode film 60 is used as the common electrode of the piezoelectric element 300, and the upper electrode film 80 is used as an individual electrode of the piezoelectric element 300. Alternatively, the lower electrode film 60 may be used as the individual electrode, and the upper electrode film 80 may be used as the common electrode for the convenience of a drive circuit or wiring. In any case, the piezoelectric active portion is provided on each of the pressure-generating chambers 12. Herein, the combination of the piezoelectric element 300 and the diaphragm in which a displacement is generated by the driving of the piezoelectric element 300 is referred to as "piezoelectric actuator". In the above-described example, the elastic film 50, the insulating film 55, and the lower electrode film 60 function as the diaphragm. Alternatively, only the lower electrode film 60 may be formed and used as the diaphragm without forming the elastic film 50 and the insulating film 55.

As shown in FIGS. 3A and 3B, the recesses 51 each opening to the side of the corresponding pressure-generating chamber 12 are provided in area of the elastic film 50, which is the bottom layer of the diaphragm of this embodiment, the areas facing the corresponding pressure-generating chamber 12. Each of the recesses 51 is provided so that opening edges of the recess 51 are disposed at the same positions as corners each defined by the inner surface of the corresponding partition wall 11, the inner surface defining the side surface of the pressure-generating chamber 12, and a surface of the partition wall 11 to which the elastic film 50 is joined. Each side surface of the recess 51 forms an inclined surface 52 which is inclined toward the inside surface close to the piezoelectric element 300. That is, the recess 51 is provided so that the width of the recess at the bottom surface of the recess (at the piezoelectric element 300 side of the recess 51) is smaller than the width of the recess at the opening edges side thereof. In this embodiment, the inclined surface 52 is composed of a first tapered portion 53 and a second tapered portion 54. The first tapered portion 53 is disposed at the opening edge side (pressure-generating chambers 12 side) of the recess 51 and has a large angle of inclination with respect to the thickness direction of the elastic film 50. The second tapered portion 54 is disposed at the piezoelectric element 300 side of the recess 51 and has a small angle of inclination.

As described above, the recesses 51 can be formed by simultaneously removing a part of the elastic film 50, which is the bottom layer of the diaphragm, in the thickness direction thereof, and a part of the partition walls 11 in the width direction thereof when the pressure-generating chambers 12 are formed by anisotropically etching the channel-forming substrate 10. More specifically, as is described in detail below, when the pressure-generating chambers 12 and other portions are formed by anisotropically etching the channel-forming substrate 10, the recesses 51 can also be formed by removing a part of the elastic film 50 and a part of the partition walls 11 by etching. In this step, the recesses 51 are formed utilizing a property that silicon dioxide and the partition walls 11 are etched at etching rates lower than the etching rate of the (110) plane of the single-crystal silicon substrate while controlling the etching time of the anisotropic etching of the channel-forming substrate 10.

As described above, the recesses 51 which open to the side of the pressure-generating chambers 12 so as to have the same width as that of the pressure-generating chambers 12 are provided on the elastic film 50, which is the bottom layer of the diaphragm. Thereby, the thickness of the elastic film 50 in areas facing the pressure-generating chambers 12 is reduced to improve the displacement characteristics of the piezoelectric elements 300. Consequently, the ink-discharging characteristics can be improved. Furthermore, the opening edges of the recess 51 are disposed at the same positions as corners each defined by the inner surface of the corresponding partition wall 11, the inner surface defining the side surface in the direction in which the short side of the pressure-generating chamber 12 extends, and a surface of the partition wall 11 to which the elastic film 50 is joined. In this structure, the recess 51 opens so as to have the same width as the width of the pressure-generating chamber 12. Accordingly, the area of the adhered surface between each partition wall 11 and the elastic film 50 is not decreased even when the recess 51 is formed. Thus, the adhesiveness between each partition wall 11 and the elastic film 50 can be improved. Accordingly, when the diaphragm is displaced by the driving of the piezoelectric elements 300, separation of the elastic film 50 from the partition walls 11 can be prevented. The driving durability is improved, thereby improving the reliability.

Furthermore, when each side surface of the recess 51 constitutes the inclined surface 52, the thickness of the elastic film 50 at the boundary portion between each partition wall 11 and the pressure-generating chamber 12 can be ensured, thus improving the rigidity. This structure can prevent the generation of breakages, such as cracks, of the diaphragm in the boundary portion between each partition wall 11 and the pressure-generating chamber 12.

As described above, the opening edges of each of the recesses 51 are disposed at the same positions as corners of the partition walls 11. In this structure, when the protective film 200 is formed on the inner surfaces of the pressure-generating chambers 12, the recesses 51, the communication section 13, and the ink supply channels 14, the uniformity of the protective film 200 can be improved, thus preventing breakage of the channel-forming substrate 10 due to infiltration of ink. In contrast, for example, when a recess is provided on the inner surface of a partition wall at the side of the elastic film 50, or when a recess is provided so as to have a width larger than the width of the pressure-generating chamber 12, it is difficult to form the protective film 200 on the recess of the partition wall, the corners of the recess, or the like, as a continuous film having a uniform thickness. In such a case, ink may infiltrate from the boundary area where the protective film 200 is discontinuously formed, resulting in breakage of the channel-forming substrate 10.

A lead electrode 90 made of gold (Au) or the like and extending to the ink supply channel 14 side of the channel-forming substrate 10 is connected to the upper electrode film 80 of each piezoelectric element 300. A voltage is selectively applied to the piezoelectric elements 300 via the lead electrodes 90.

Furthermore, the protective substrate 30 is bonded on the channel-forming substrate 10 on which the piezoelectric elements 300 are provided, with an adhesive 35 therebetween. The protective substrate 30 includes a reservoir section 31 provided in an area facing the communication section 13. As described above, the reservoir section 31 communicates with the communication section 13 of the channel-forming substrate 10 to form the reservoir 100 serving as a common ink chamber of the pressure-generating chambers 12.

A piezoelectric element-holding section 32 is provided in an area of the protective substrate 30 facing the piezoelectric elements 300. This piezoelectric element-holding section 32 forms a space having dimensions such that the piezoelectric element-holding section 32 does not hamper the movement of the piezoelectric elements 300. It is sufficient that the piezoelectric element-holding section 32 has dimensions such that the piezoelectric element-holding section 32 does not hamper the movement of the piezoelectric elements 300. The space formed by the piezoelectric element-holding section 32 may be sealed or may not be sealed.

A through-hole 33 penetrating the protective substrate 30 in the thickness direction is provided in an area between the piezoelectric element-holding section 32 and the reservoir section 31 of the protective substrate 30. A part of the lower electrode film 60 and the leading ends of the lead electrodes 90 are exposed in the through-hole 33.

A drive circuit 120 for driving the piezoelectric elements 300 is mounted on the protective substrate 30. For example, a circuit board or a semiconductor integrated circuit (IC) can be used as the drive circuit 120. The drive circuit 120 is electrically connected to each lead electrode 90 via a connecting wiring 121 composed of a conductive wire such as a bonding wire.

The protective substrate 30 is preferably composed of a material having substantially the same coefficient of thermal expansion as that of the channel-forming substrate 10. Exampled of the material include glass and ceramics. In this embodiment, the protective substrate 30 is prepared using a single-crystal silicon substrate having a plane direction of (110), which is the same material as the channel-forming substrate 10.

A compliance substrate 40 composed of a sealing film 41 and a fixing plate 42 is boned on the protective substrate 30. The sealing film 41 is made of a flexible material having a low rigidity (for example, a polyphenylene sulfide (PPS) film having a thickness of 6 μm). One side of the reservoir section 31 is sealed with the sealing film 41. The fixing plate 42 is made of a hard material such as a metal (for example, a stainless steel (SUS) sheet having a thickness of 30 μm). An opening portion 43, which is prepared by entirely removing the fixing plate 42 in its thickness direction, is formed in an area facing the reservoir 100 of this fixing plate 42. Thus, one side of the reservoir 100 is sealed only with the sealing film 41 having flexibility.

In the ink jet recording head of this embodiment, ink is supplied from an external ink supply unit (not shown), and the inside of the ink jet recording head ranging from the reservoir 100 to the nozzle orifices 21 is filled with the ink. A voltage is then applied between the lower electrode film 60 and the upper electrode film 80 corresponding to each pressure-generating chamber 12 in accordance with recording signals from the drive circuit 120. The elastic film 50, the insulating film 55, the lower electrode film 60, and the piezoelectric layer 70 are thereby subjected to flexible deformation. Consequently, the pressures in the pressure-generating chambers 12 are increased and ink droplets are discharged from the nozzle orifices 21.

A method of producing the ink jet recording head will now be described with reference to FIGS. 4A to 8B. FIGS. 4A to 8B are cross-sectional views in the parallel arrangement direction of pressure-generating chambers showing the process of producing the ink jet recording head.

Figure 4A:
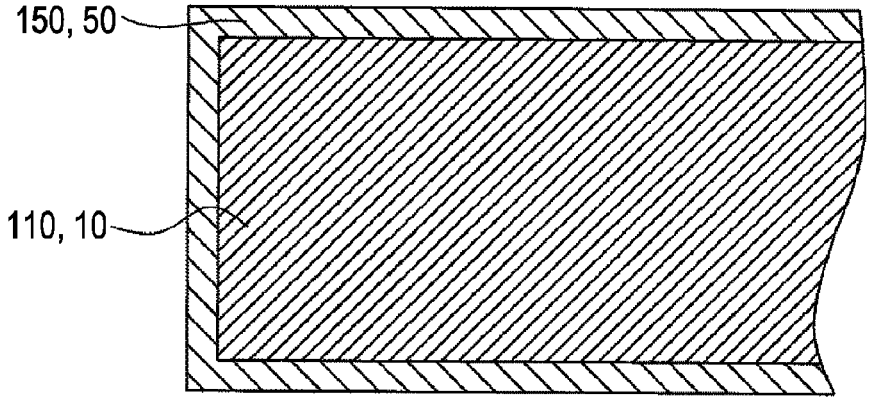
FIGS. 4A to 4C are cross-sectional views showing a process of producing the recording head according to the first embodiment.

First, as shown in FIG. 4A, a channel-forming substrate wafer 110, which is a silicon wafer composed of a single-crystal silicon substrate, is thermally oxidized in a diffusion furnace at about 1,100° C. to form a silicon dioxide film 150 constituting an elastic film 50 on the surface of the wafer 110. In this embodiment, a silicon wafer in which the preferential plane direction is the (110) plane and which has a relatively large thickness of about 625 μm and high rigidity is used as the channel-forming substrate wafer 110.

Figure 4B:
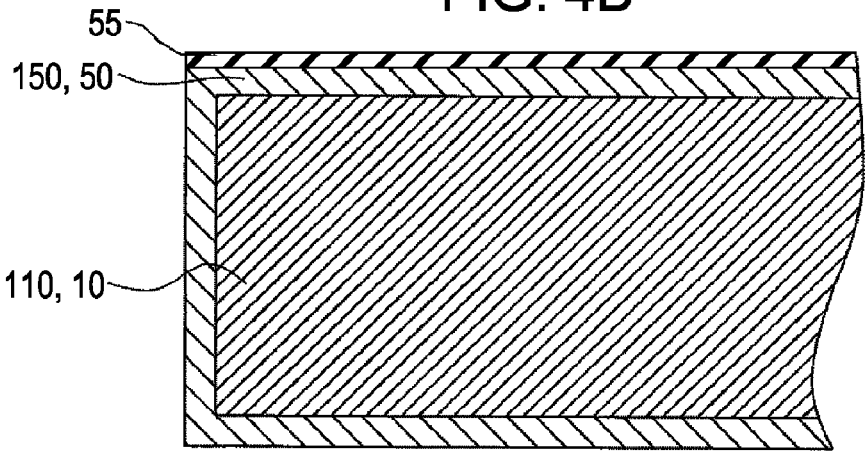

Next, as shown in FIG. 4B, an insulating film 55 made of zirconium oxide is formed on the elastic film 50 (silicon dioxide film 150). More specifically, a zirconium (Zr) layer is formed on the elastic film 50 (silicon dioxide film 150) by a sputtering method or the like, and the zirconium layer is then, for example, thermally oxidized in a diffusion furnace in a temperature range of 500° C. to 1,200° C. Thus, the insulating film 55 made of zirconium oxide ($ZrO_2$) is formed.

Figure 4C:
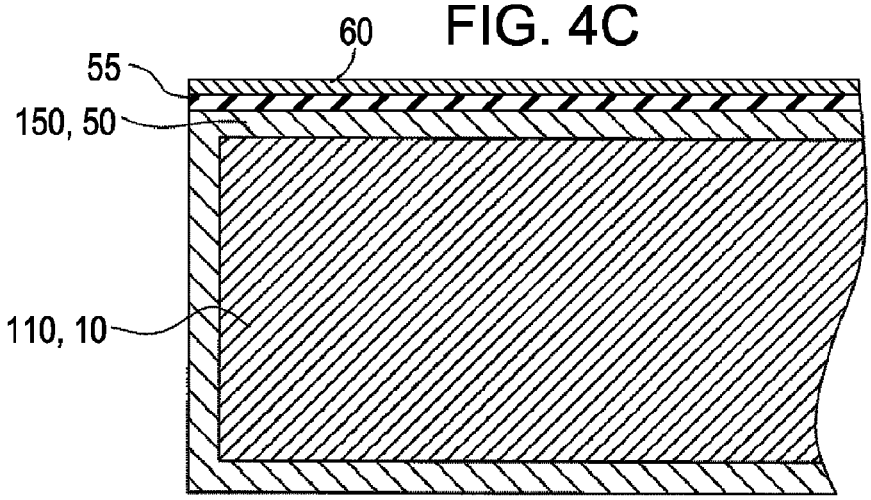
Figure 5A:
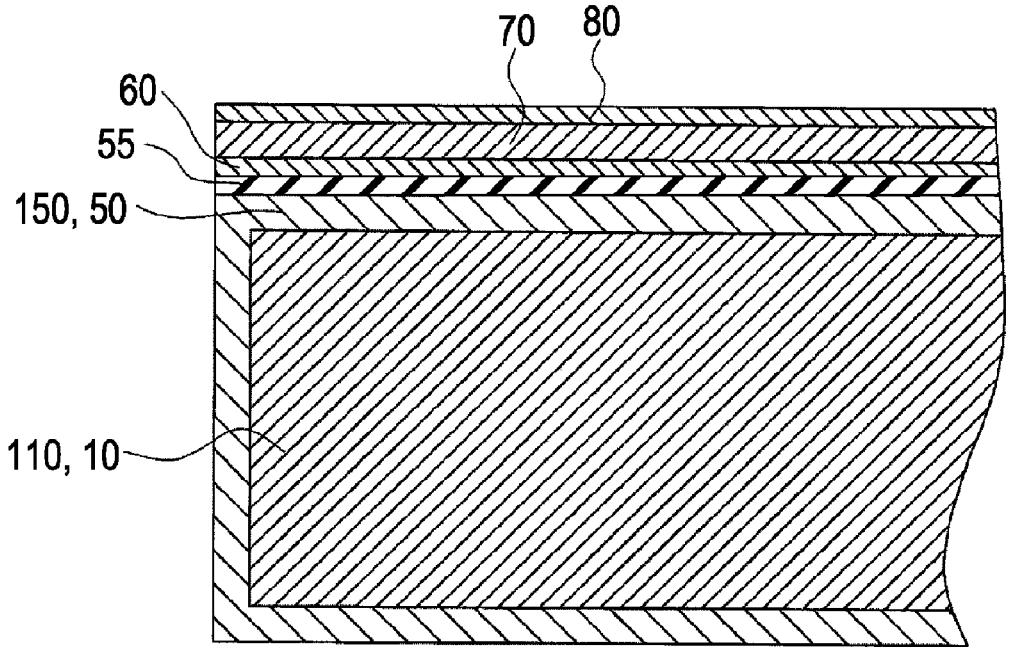
FIGS. 5A and 5B are cross-sectional views showing the process of producing the recording head according to the first embodiment.
Figure 5B:
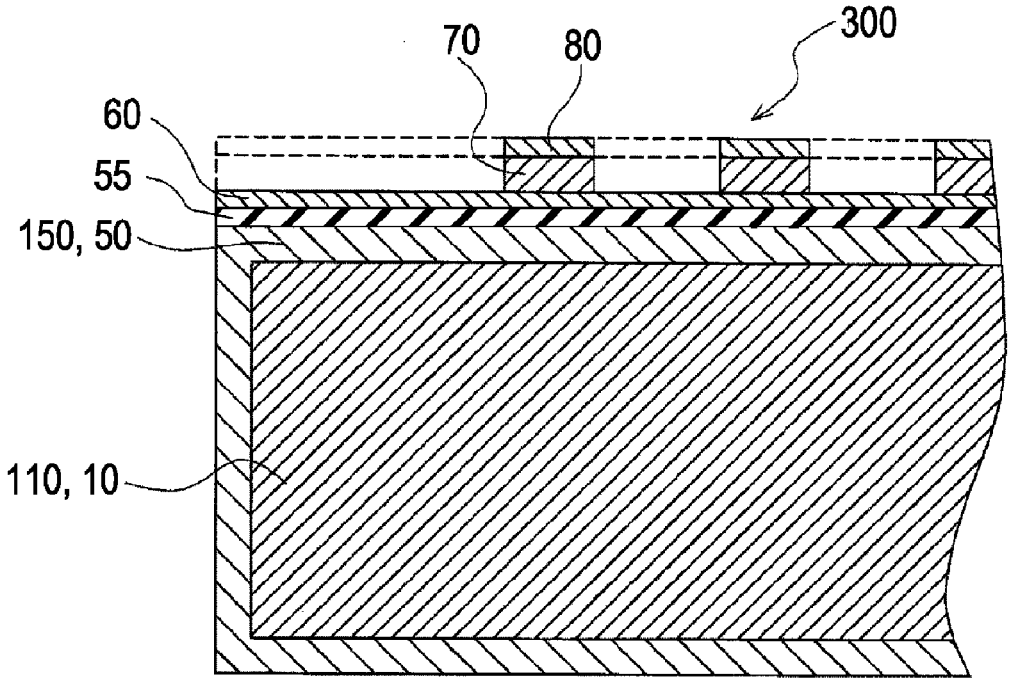

Subsequently, as shown in FIG. 4C, for example, platinum (Pt) and iridium (Ir) are stacked on the insulating film 55 to form a lower electrode film 60. The lower electrode film 60 is then patterned so as to have a predetermined shape. As shown in FIG. 5A, for example, a piezoelectric layer 70 made of lead zirconate titanate (PZT) or the like, and, for example, an upper electrode film 80 made of iridium are formed on the entire surface of the channel-forming substrate wafer 110. As shown in FIG. 5B, these piezoelectric layer 70 and upper electrode film 80 are patterned in areas facing pressure-generating chambers 12, thus forming piezoelectric elements 300.

Examples of the material of the piezoelectric layer 70 constituting the piezoelectric elements 300 include ferroelectric piezoelectric materials such as lead zirconate titanate (PZT) and relaxor ferroelectric materials in which a metal such as niobium, nickel, magnesium, bismuth, or yttrium is added to the ferroelectric piezoelectric materials. The composition of the material is appropriately selected in consideration of, for example, the characteristics and the application of the piezoelectric elements 300. The method of forming the piezoelectric layer 70 is not particularly limited. For example, in this embodiment, the piezoelectric layer 70 is formed by a sol-gel method. More specifically, a sol prepared by dissolving and dispersing an organometallic compound in a catalyst is applied and dried to form a gel, and the gel is then fired at a high temperature to obtain the piezoelectric layer 70 made of a metal oxide. The method of forming the piezoelectric layer 70 is not limited to the sol-gel method. Alternatively, an MOD method or a sputtering method may be employed.

Figure 6A:
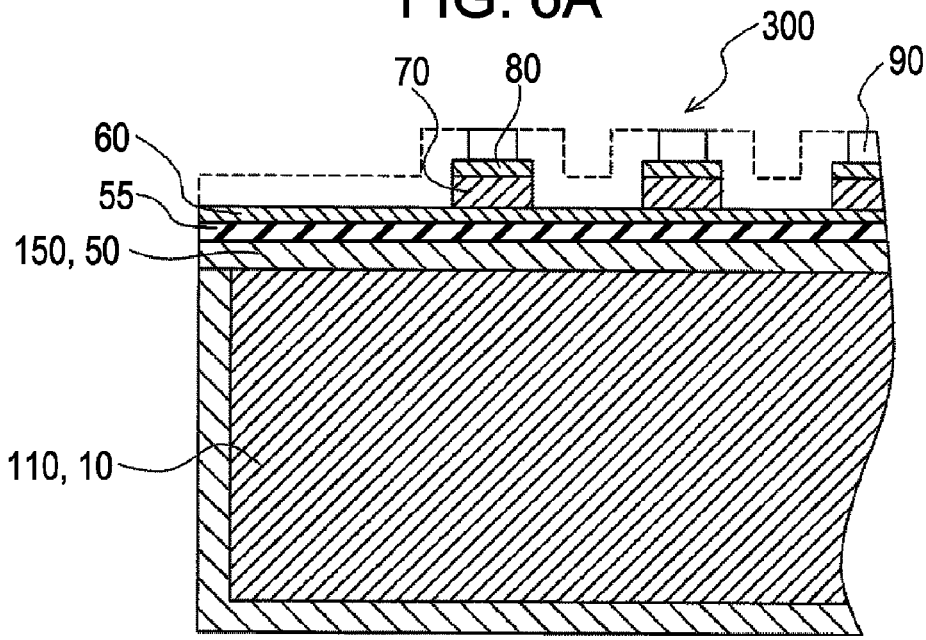
FIGS. 6A and 6B are cross-sectional views showing the process of producing the recording head according to the first embodiment.

As shown in FIG. 6A, a lead electrode 90 made of gold (Au) is formed on the entire surface of the channel-forming substrate wafer 110 and then patterned for each piezoelectric element 300.

Figure 6B:
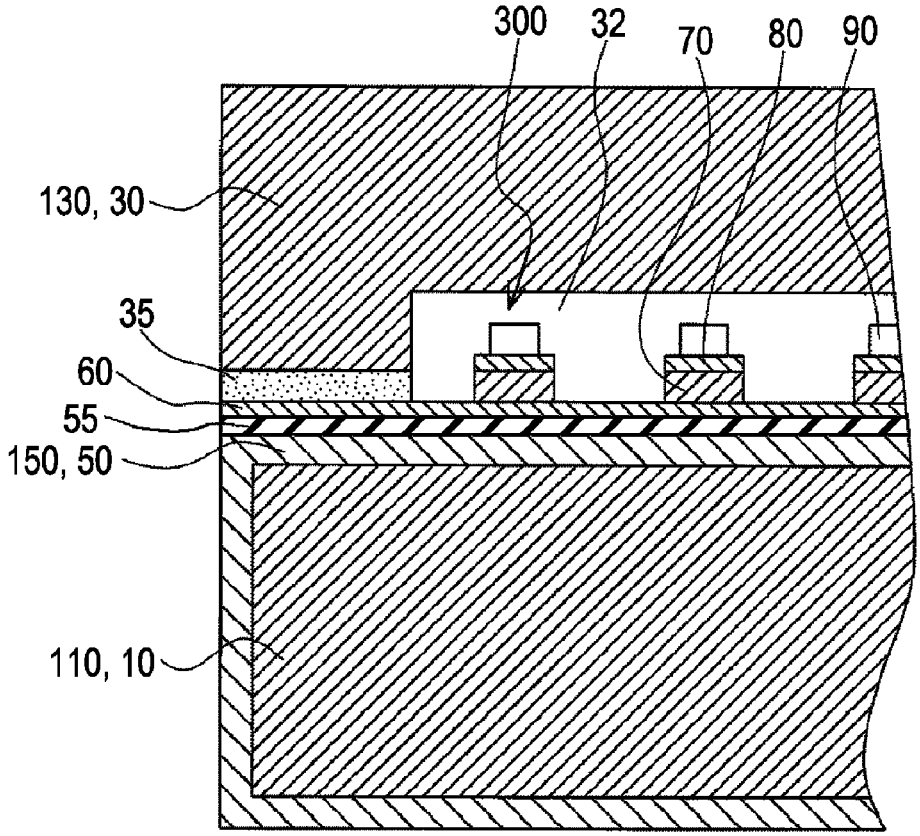

Next, as shown in FIG. 6B, a protective substrate wafer 130 is joined on the channel-forming substrate wafer 110, with an adhesive 35 therebetween. A reservoir section 31 and a piezoelectric element-holding section 32 are formed in the protective substrate wafer 130 in advance. Since this protective substrate wafer 130 has a thickness of, for example, about 400 μm, the rigidity of the channel-forming substrate wafer 110 is markedly improved by joining the protective substrate wafer 130 thereto.

Figure 7A:
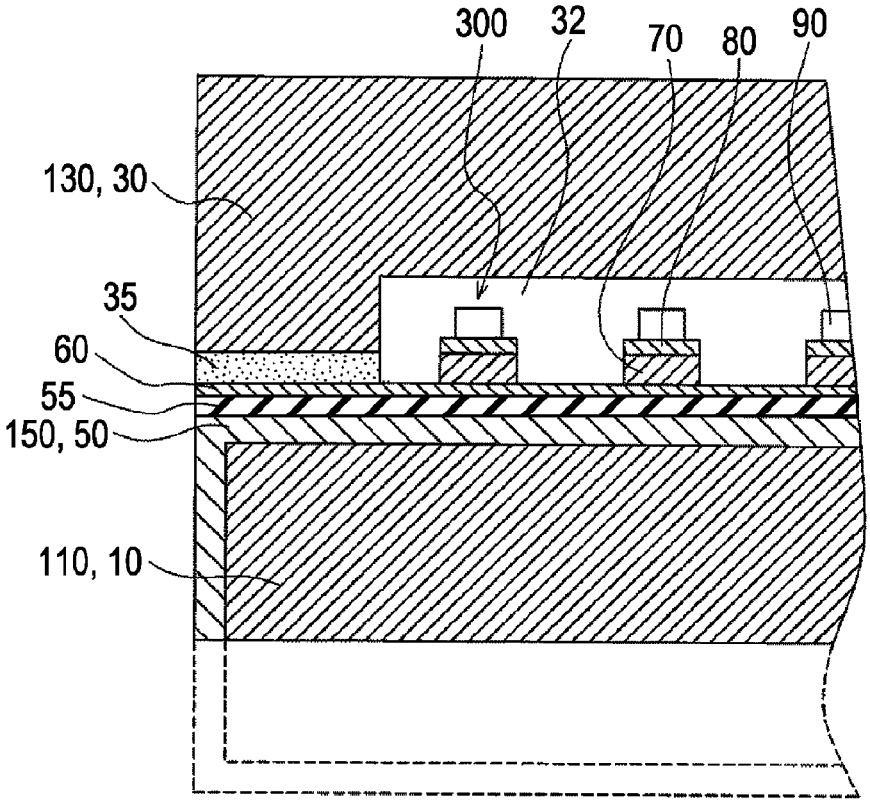
FIGS. 7A and 7B are cross-sectional views showing the process of producing the recording head according to the first embodiment.

Subsequently, as shown in FIG. 7A, the channel-forming substrate wafer 110 is polished until the thickness thereof is reduced to a certain degree. The channel-forming substrate wafer 110 is then subjected to a wet etching using a mixture of hydrofluoric acid and nitric acid so as to have a predetermined thickness. For example, in this embodiment, the channel-forming substrate wafer 110 is processed by polishing and wet etching so as to have a thickness of about 70 μm.

Figure 7B:
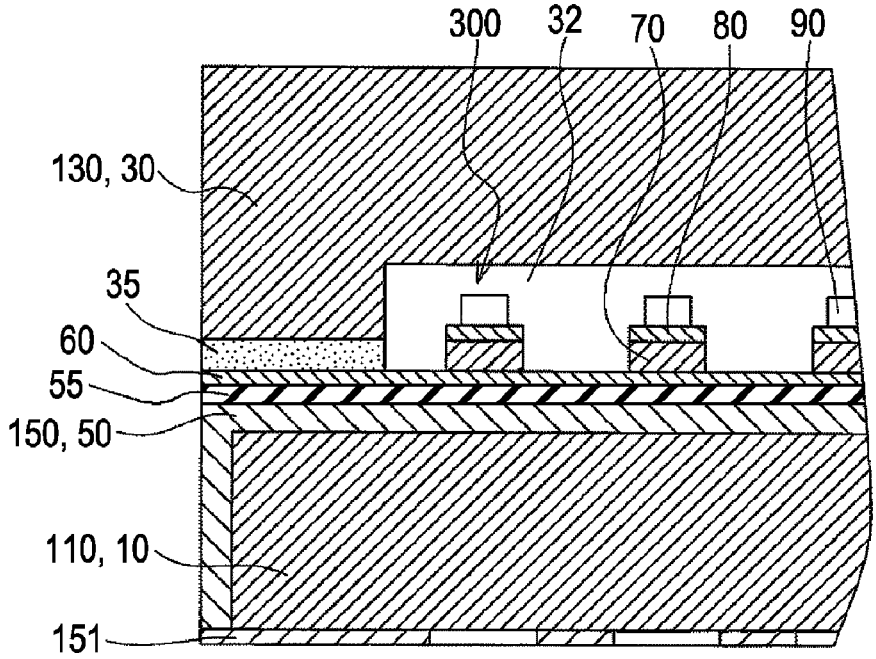
Figure 8A:
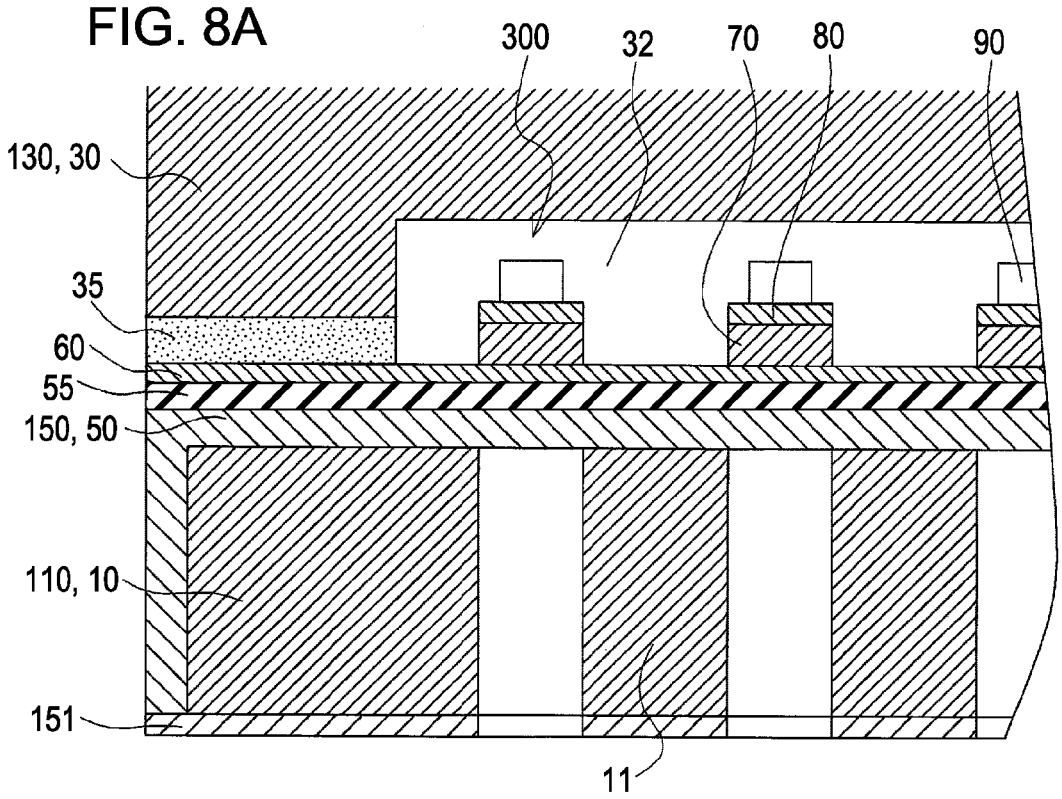
FIGS. 8A and 8B are enlarged cross-sectional views of the relevant part showing the process of producing the recording head according to the first embodiment.
Figure 8B:
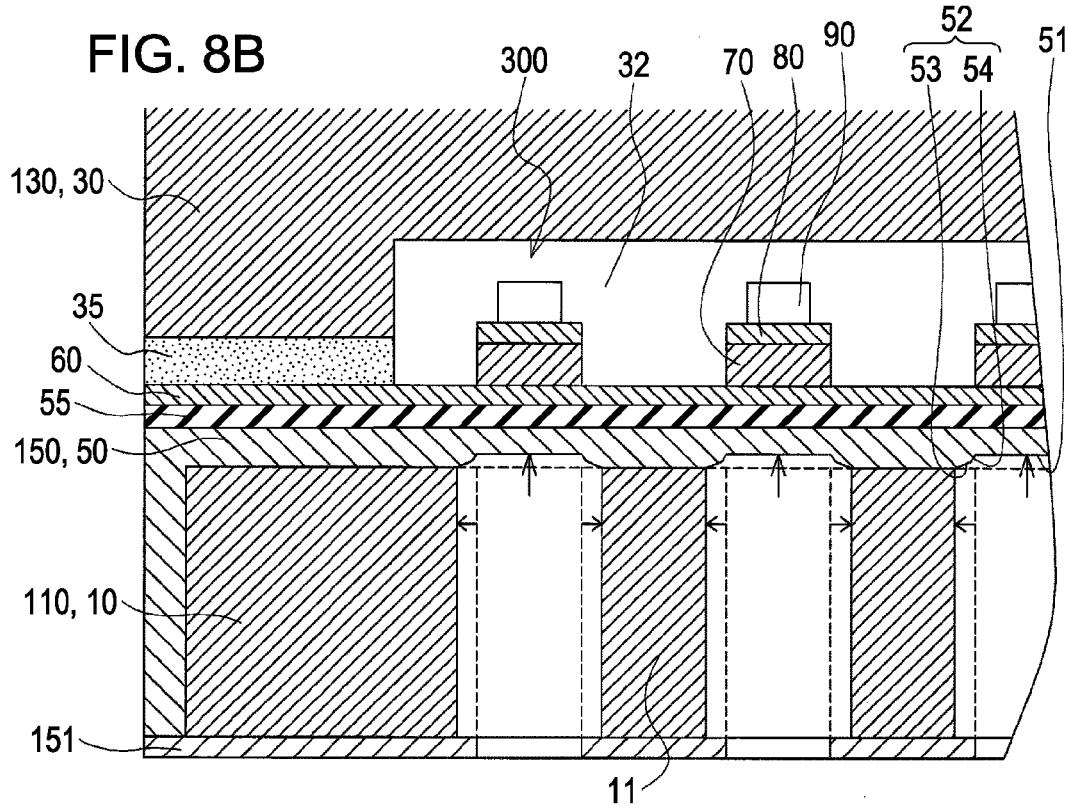

Next, as shown in FIG. 7B, a mask film 151 made of, for example, silicon nitride (SiN) is formed on the channel-forming substrate wafer 110 and then patterned so as to have a predetermined shape. Subsequently, pressure-generating chambers 12, a communication section 13, and ink supply channels 14 are formed by performing anisotropic etching (a wet etching) of the channel-forming substrate wafer 110 via the mask film 151. More specifically, when the channel-forming substrate wafer 110 is immersed in an alkaline solution such as an aqueous potassium hydroxide (KOH) solution, as shown in FIG. 8A, the channel-forming substrate wafer 110 is anisotropically etched in the thickness direction thereof. Consequently, the pressure-generating chambers 12, the ink supply channels 14, and the communication section 13 each formed by first (111) planes and second (111) planes are formed. In this case, the inner surfaces of the partition walls 11 defining the side surfaces of the pressure-generating chamber 12 arranged in a direction in which a short side of the pressure-generating chamber 12 extends are composed of the first (111) planes. After the pressure-generating chambers 12 and other portions are formed, as shown in FIG. 8B, a part of the elastic film 50 is anisotropically etched in the thickness direction thereof, and a part of each of the partition walls 11, i.e., the first (111) plane, is anisotropically etched in the width direction thereof, i.e., in a direction in which a short side of the pressure-generating chamber 12 extends. Thereby, recesses 51 are formed in the elastic film 50. The etching rate of silicon dioxide ($SiO_2$) is lower than the etching rate of the first (111) planes of the single-crystal silicon substrate. By utilizing the difference in the etching rate between them, inclined surfaces 52 each composed of a first tapered portion 53 and a second tapered portion 54 are formed on the side surfaces of each recess 51. The recess 51 having such inclined surfaces 52 can be formed so that the opening edges of the recess 51 are disposed at the same positions as corners each defined by the inner surface of the corresponding partition wall 11, the inner surface defining the side surface of the pressure-generating chamber 12 arranged in a direction in which a short side of the pressure-generating chamber 12 extends, and a surface of the partition wall 11 to which the elastic film 50 is joined.

It is known that the etching rates of the (110) plane and the first (111) plane of the single-crystal silicon substrate and the etching rate of silicon dioxide ($SiO_2$) change depending on the concentration and the temperature of the etchant (aqueous KOH solution).

For example, when an etchant having a KOH concentration of 40% is used at 40° C., the etching rate of the (110) plane of a single-crystal silicon substrate is 8.0 μm/h, the etching rate of the first (111) plane of the silicon substrate is 40 nm/h, and the etching rate of silicon dioxide ($SiO_2$) is 11 nm/h.

When an etchant having a KOH concentration of 40% is used at 80° C., the etching rate of the (110) plane of a single-crystal silicon substrate is 99 μm/h, the etching rate of the first (111) plane of the silicon substrate is 11 μm/h, and the etching rate of silicon dioxide ($SiO_2$) is 400 nm/h.

As described above, the etching rates of the (110) plane, the first (111) plane, and silicon dioxide ($SiO_2$) differ depending on the temperature and the concentration of the etchant. Therefore, when the recesses 51 are formed by utilizing this difference in the etching rates, the side surfaces of the recesses 51 can be formed as the inclined surfaces 52 each composed of the first tapered portion 53 and the second tapered portion 54.

As described above, when the pressure-generating chambers 12 and other portions are formed, the recesses 51 are formed at the same time by anisotropically etching the channel-forming substrate wafer 110. Thus, the recesses 51 having a desired shape can be easily formed with high accuracy.

Subsequently, the mask film 151 provided on the channel-forming substrate wafer 110 at the open surface side of the pressure-generating chambers 12 is removed. A protective film 200 having an ink resistance (liquid resistance) is formed on the inner surfaces of the pressure-generating chambers 12 and other portions of the channel-forming substrate wafer 110. Unnecessary portions at the outer peripheries of the channel-forming substrate wafer 110 and the protective substrate wafer 130 are then removed by cutting with a dicing cutter or the like. A nozzle plate 20 having nozzle orifices 21 drilled therein is joined on a surface of the channel-forming substrate wafer 110, the surface opposite the surface adjacent to the protective substrate wafer 130. Furthermore, a compliance substrate 40 is joined on the protective substrate wafer 130. The channel-forming substrate wafer 110 and other components are then divided into a chip-sized channel-forming substrate 10 and the like, as shown in FIG. 1. Thus, the ink jet recording head having the above-described structure is produced.

Other Embodiments

The first embodiment of the invention has been described, but the fundamental structure of the invention is not limited to the above embodiment. For example, in the above-described first embodiment, each of the side surfaces of the recess 51 is composed of the inclined surface 52 having the first tapered portion 53 and the second tapered portion 54. However, the shape of the side surfaces of the recess 51 is not particularly limited thereto. For example, by controlling the temperature and the concentration of the etchant, the first tapered portion may be formed so as to have a small angle of inclination with respect to the thickness direction of the elastic film 50, and the second tapered portion may be formed so as to have a large angle of inclination with respect to the thickness direction of the elastic film 50. That is, in the first embodiment, the first tapered portion 53 and the second tapered portion 54 form a convex inclined surface 52. Alternatively, the first tapered portion 53 and the second tapered portion 54 may form a concave inclined surface. In the first embodiment, each of the inclined surfaces 52 of the recess 51 is composed of the first tapered portion 53 and the second tapered portion 54, but the structure of the inclined surfaces 52 is not particularly limited thereto. For example, each of the inclined surfaces 52 of the recess 51 may be composed of three or more tapered portions having different angles of inclination.

Figure 9:
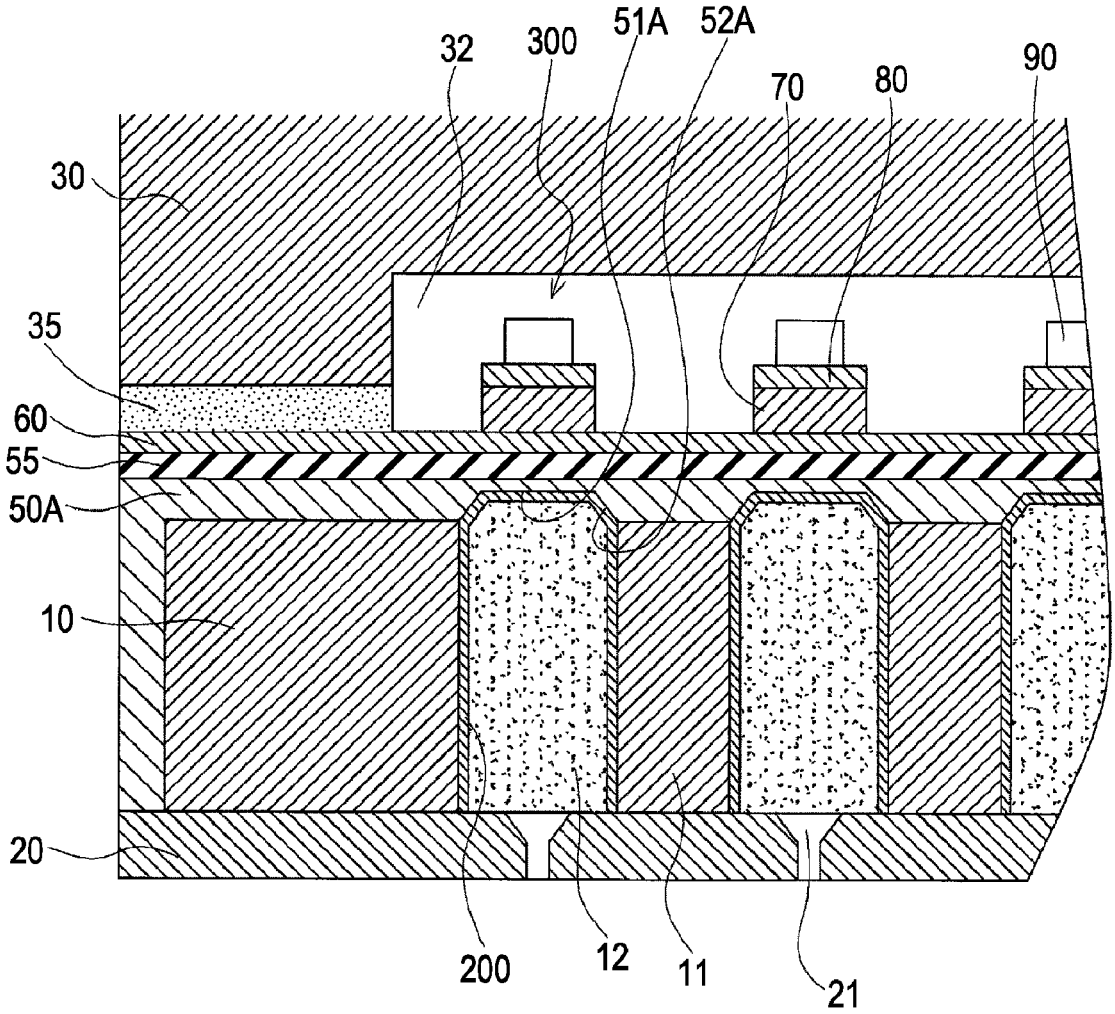
FIG. 9 is a cross-sectional view of a recording head according to another embodiment.

Alternatively, as shown in FIG. 9, each inclined surface 52A of recesses 51A of an elastic film 50A may be formed so as to have a flat shape. FIG. 9 is a cross-sectional view in the parallel arrangement direction of pressure-generating chambers showing another embodiment of an ink jet recording head. For example, these recesses 51A can be formed as follows. As in the first embodiment, when the pressure-generating chambers 12 and other portions are formed by anisotropically etching the channel-forming substrate wafer 110, the inclined surfaces 52 each composed of the first tapered portion 53 and the second tapered portion 54 are formed at the same time by anisotropically etching the elastic film 50 and the partition walls 11. The inclined surfaces 52 of the recesses 51 of the elastic film 50 are then subjected to a dry etching, thus forming the recesses 51A. Alternatively, when the temperature and the concentration of the etchant are appropriately controlled, a shape of the recesses that is similar to the shape shown in FIG. 9 can be formed by performing only anisotropic etching.

In the first embodiment, the channel-forming substrate 10 is composed of a single-crystal silicon substrate having a crystal plane direction of (110), but is not particularly limited thereto. Alternatively, for example, a single-crystal silicon substrate having a crystal plane direction of (100) may be used as the channel-forming substrate 10. In this case, the above-described recesses 51 or 51A can also be formed by anisotropic etching.

Furthermore, in the first embodiment, the recesses 51 are formed on the elastic film 50 constituting the diaphragm, and the recesses 51A are formed on the elastic film 50A. Alternatively, when the diaphragm is formed so that the lower electrode film 60 is exposed to the pressure-generating chambers 12 without forming the elastic film 50 and the insulating film 55, recesses having a shape corresponding to that of the recesses 51 or the recessed 51A may be formed on a surface of the lower electrode film 60, the surface adjacent to the pressure-generating chambers 12, thus forming the inclined surfaces 52 or 52A described in the first embodiment. This structure can also provide the same advantages as those obtained from the structure of the first embodiment.

Figure 10:
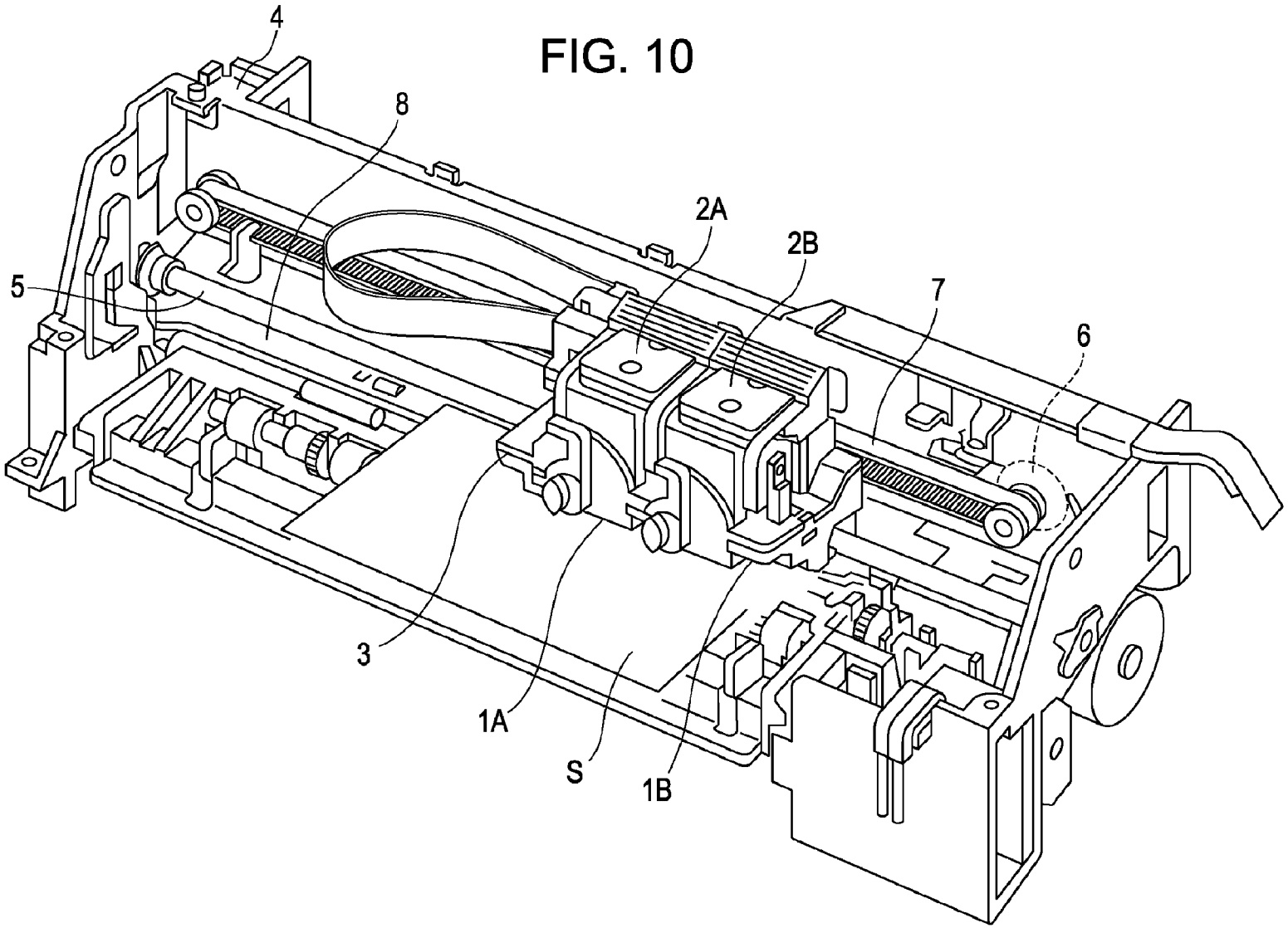
FIG. 10 is a schematic view of an ink jet recording apparatus according to an embodiment.

The ink jet recording head of any of these embodiments constitutes a part of a recording head unit including ink channels and communicating with an ink cartridge or the like, and is installed in an ink jet recording apparatus. FIG. 10 is a schematic view showing an example of such an ink jet recording apparatus.

As shown in FIG. 10, cartridges 2A and 2B constituting ink supply units are provided on recording head units 1A and 1B, respectively, each including the ink jet recording head in such a manner that the cartridges 2A and 2B can be attached thereto and detached therefrom. A carriage 3 mounting these recording head units 1A and 1B is provided in a carriage shaft 5 attached to an apparatus main body 4 so as to freely move in the axial direction. These recording head units 1A and 1B are, for example, units that discharge a black ink composition and a color ink composition.

A driving force of a drive motor 6 is transmitted to the carriage 3 through a plurality of gears (not shown) and a timing belt 7, whereby the carriage 3 mounting the recording head units 1A and 1B is moved along the carriage shaft 5. A platen 8 is provided along the carriage shaft 5 in the apparatus main body 4. A recording sheet S, such as paper, used as a recording medium and fed by a paper-feeding roller (not shown) or the like is transported while rolling on the platen 8.

In the above embodiments, a description has been made using a piezoelectric element as a pressure-generating element. Alternatively, an electrostatic actuator, in which a diaphragm and an electrode are disposed with a predetermined gap therebetween and the vibration of the diaphragm is controlled by an electrostatic force, may be used as the pressure-generating element. In the above embodiments, a description has been made using an ink jet recording head as an example of a liquid ejecting head. The invention is widely applied to general liquid ejecting heads and can also be applied to a method of producing a liquid ejecting head that ejects a liquid other than ink. Examples of the other liquid ejecting heads include various recording heads used in an image-recording apparatus, such as a printer, colorant-ejecting heads used for producing a color filter of a liquid crystal display or the like, electrode material-ejecting heads used for forming an electrode of an organic electroluminescent (EL) display or a field-emission display (FED), and biological organic substance-ejecting heads used for producing a biochip.

What is claimed is:

1. A liquid ejecting head comprising:

a channel-forming substrate that communicates with nozzle orifices for ejecting a liquid and that includes a plurality of pressure-generating chambers separated by a plurality of partition walls and arranged in parallel in a direction in which a short side thereof extends; and pressure-generating elements that are provided on a surface of the channel-forming substrate, with a diaphragm therebetween, and that provide the pressure-generating chambers with a pressure change, wherein recesses that open to the side of the pressure-generating chambers are provided on areas of the diaphragm, the areas facing the pressure-generating chambers, opening edges of each of the recesses are disposed at the same positions as corners each defined by an inner surface of the corresponding partition wall, the inner surface defining a side surface of the pressure-generating chamber, and a surface of the partition wall that is joined to the diaphragm, and side surfaces of each of the recesses form inclined surfaces that are inclined so that the width of the recess at the bottom surface of the recess is smaller than the width of the recess at the opening edges of the recess.

2. The liquid ejecting head according to claim 1, wherein each of the inclined surfaces of the recess is composed of a plurality of tapered portions having different angles of inclination.

3. The liquid ejecting head according to claim 2, wherein, among the tapered portions, a tapered portion closer to the pressure-generating element has a smaller angle of inclination with respect to the thickness direction of the diaphragm.

4. The liquid ejecting head according to claim 1, wherein a protective film having a liquid resistance is provided on the inner surfaces of the pressure-generating chambers.

5. The liquid ejecting head according to claim 1, wherein the channel-forming substrate is composed of a single-crystal silicon substrate, the bottom layer of the diaphragm, the bottom layer being adjacent to the channel-forming substrate, is composed of an elastic film made of silicon dioxide, and the recesses are provided on the elastic film.

6. A liquid ejecting apparatus comprising the liquid ejecting head according to claim 1.

7. A method of producing a liquid ejecting head including a channel-forming substrate that communicates with nozzle orifices for ejecting a liquid and that includes a plurality of pressure-generating chambers separated by a plurality of partition walls and arranged in parallel in a direction in which a short side thereof extends; and pressure-generating elements that are provided on a surface of the channel-forming substrate, with a diaphragm therebetween, and that provide the pressure-generating chambers with a pressure change, wherein recesses that open to the side of the pressure-generating chambers are provided on areas of the diaphragm, the areas facing the pressure-generating chambers, opening edges of each of the recesses are disposed at the same positions as corners each defined by an inner surface of the corresponding partition wall, the inner surface defining a side surface of the pressure-generating chamber, and a surface of the partition wall that is joined to the diaphragm, and side surfaces of each of the recesses form inclined surfaces that are inclined so that the width of the recess at the bottom surface of the recess is smaller than the width of the recess at the opening edges of the recess, the method comprising:

forming the diaphragm and the pressure-generating elements on a surface of the channel-forming substrate; and anisotropically etching the channel-forming substrate from the side of another surface thereof, thereby forming the pressure-generating chambers in which the direction in which the short side thereof extends is defined by the partition walls, and in addition, thereby etching the partition walls in the direction in which the short side thereof extends, and etching areas of the diaphragm, the areas facing the pressure-generating chambers to form the recesses each having the inclined surfaces utilizing a difference between the etching rate of the partition walls and the etching rate of the diaphragm.

* * * * *